US011104024B2

(12) United States Patent
Yazvin et al.

(10) Patent No.: US 11,104,024 B2
(45) Date of Patent: Aug. 31, 2021

(54) PRODUCE PUSHER

(71) Applicant: Prince Castle LLC, Carol Stream, IL (US)

(72) Inventors: Aleksandr Yazvin, Glenview, IL (US); Alexander Malevanets, Vernon Hills, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 83 days.

(21) Appl. No.: 16/448,352

(22) Filed: Jun. 21, 2019

(65) Prior Publication Data

US 2019/0389086 A1 Dec. 26, 2019

Related U.S. Application Data

(60) Provisional application No. 62/688,591, filed on Jun. 22, 2018.

(51) Int. Cl.
*B26D 7/06* (2006.01)
*B26D 5/10* (2006.01)
(Continued)

(52) U.S. Cl.
CPC ..... *B26D 7/0608* (2013.01); *B26D 1/03* (2013.01); *B26D 5/10* (2013.01); *B26D 7/01* (2013.01);
(Continued)

(58) Field of Classification Search
CPC ..... B26D 1/03; B26D 2210/02; B26D 5/10; B26D 7/01; B26D 7/0608; B26D 7/2614
See application file for complete search history.

(56) References Cited

U.S. PATENT DOCUMENTS 2,563,237 A 6/1947 Grocoff
D164,693 S 10/1951 Kooas
(Continued)

FOREIGN PATENT DOCUMENTS

DE 29621638 10/1997
DE 102004002070 8/2005
(Continued)

OTHER PUBLICATIONS

Edlund, Manual Fruit & Vegetable Slicer, 2014.
(Continued)

*Primary Examiner* — Stephen Choi
(74) *Attorney, Agent, or Firm* — Andrus Intellectual Property Law, LLP

(57) ABSTRACT

A produce pusher for use in a produce slicer includes a T-bracket. The T-bracket includes a base plate and a projection. A first fin and a second fin of a plurality of fins extend parallel to and in contact with the projection. A third fin of the plurality of fins extends parallel to the first fin on a side of the first fin opposite the projection. A fourth fin of the plurality of fins extends parallel to the second fin on a side of the second fin opposite the projection. A first spacer of the plurality of spacers is positioned between the first and third fins and a second spacer of the plurality of spacers is positioned between the second and fourth fins. A fastener extends through and simultaneously applies a compressive force to the plurality of fins, plurality of spacers and the projection.

15 Claims, 6 Drawing Sheets

(51) Int. Cl.
*B26D 1/03* (2006.01)
*B26D 7/01* (2006.01)
*B26D 7/26* (2006.01)

(52) U.S. Cl.
CPC ..... *B26D 7/2614* (2013.01); *B26D 2210/02* (2013.01)

(56) References Cited

U.S. PATENT DOCUMENTS

| | | | |
|---|---|---|---|
| 2,836,212 | A | 5/1958 | Albert |
| 2,916,986 | A | 12/1959 | Morris |
| 3,112,781 | A | 12/1963 | Popeil |
| 3,369,582 | A | 2/1968 | Giangiulio |
| 3,463,211 | A | 8/1969 | Holz |
| 3,605,839 | A | 9/1971 | Gerson |
| 3,924,501 | A | 12/1975 | Cohen et al. |
| 3,948,132 | A | 4/1976 | Camp |
| 4,059,037 | A | 11/1977 | Gerson et al. |
| 4,062,260 | A | 12/1977 | Steinhogl |
| 4,254,678 | A | 3/1981 | Novy et al. |
| 4,302,997 | A | 12/1981 | Jones et al. |
| 4,436,011 | A | 3/1984 | Jones |
| 4,453,458 | A | 6/1984 | Altman |
| 4,567,801 | A | 2/1986 | Jones |
| 4,573,384 | A | 3/1986 | Jones |
| 4,579,028 | A | 4/1986 | Neidhardt |
| D297,798 | S | 9/1988 | Leung |
| 4,870,719 | A | 10/1989 | Harris |
| 5,245,902 | A | 9/1993 | Pereira |
| 5,343,623 | A | 9/1994 | Cole et al. |
| 5,419,245 | A | 5/1995 | Short |
| 5,613,903 | A | 3/1997 | Fujitaki et al. |
| 5,749,145 | A | 5/1998 | Bauklah |
| D400,065 | S | 10/1998 | Fohrman |
| 6,041,682 | A | 3/2000 | Jenson et al. |
| D505,302 | S | 5/2005 | Veltrop et al. |
| D531,465 | S | 11/2006 | Tellier |
| 8,495,941 | B2 | 7/2013 | Faird et al. |
| 9,694,506 | B2 | 7/2017 | Whitmey |
| 9,914,229 | B2 | 3/2018 | Fastabend et al. |
| 2006/0185488 | A1 | 8/2006 | Short et al. |
| 2006/0225547 | A1 | 10/2006 | Stanojevic et al. |
| 2009/0241344 | A1 | 10/2009 | Nastroianni |
| 2009/0249935 | A1 | 10/2009 | Kaposki |
| 2010/0031830 | A1 | 2/2010 | Engdahl et al. |
| 2010/0212518 | A1* | 8/2010 | Sherrill ..... B26D 1/04 99/537 |
| 2010/0313724 | A1 | 12/2010 | Faird et al. |
| 2011/0283549 | A1 | 11/2011 | Moss et al. |
| 2014/0208917 | A1 | 7/2014 | Whitney |
| 2015/0224662 | A1 | 8/2015 | Whitney |
| 2016/0229075 | A1* | 8/2016 | Fastabend ..... B26D 1/03 |
| 2017/0080590 | A1 | 3/2017 | Maslana et al. |

FOREIGN PATENT DOCUMENTS

| | | |
|---|---|---|
| EP | 1570961 | 9/2005 |
| EP | 1759819 | 3/2007 |
| FR | 752033 | 9/1933 |
| GB | 467356 | 6/1937 |
| GB | 2312613 | 11/1997 |
| JP | 2003266373 | 9/2003 |

OTHER PUBLICATIONS

Nemco, Operating and Maintenance Instruction for Lettuce Kutter, 2012.
Nemco, Easy Cartride Onion Slicer, 2008.
Prince Castle LLC, Dice Witch, 2009.
Prince Castle LLC, Lettuce Kutlett, 2009.
Prince Castle LLC, Tomato Saber Operating Instructions, 1999.
Vollrath, Onion King Operator's Manual, 2014.

* cited by examiner

PRODUCE PUSHER

CROSS-REFERENCE TO RELATED APPLICATIONS

The present application claims priority of U.S. Provisional Patent Application No. 62/688,591, filed on Jun. 22, 2018, the contents of which is hereby incorporated by reference in its entirety.

BACKGROUND

Restaurant and food preparation industries require a large volume of produce to be processed such as by slicing so that the sliced produce can be used in food preparation and assembly. In addition to rapid slicing of produce, food preparation requires consistently sliced produce such that the food prepared with that produce is consistent in appearance, taste, texture, portion size, and cooking qualities between servings prepared.

Produce slicing is typically a manually performed task, however, slicing machines have been developed which are capable of slicing an entire piece of produce in a single motion. Slicing device arrangements may either push the blade through a piece of held produce, for example as disclosed in U.S. Patent Application Publication No. 2017/0080590 entitled "Food Slicer", owned by the Applicant and which is incorporated herein by reference in its entirety. In other slicers, the blade remains in a fixed position while a pusher with a plurality of fins engages the produce and pushes the produce through the stationary blades. An example of this type of slicer is disclosed in U.S. Pat. No. 9,914,229 entitled "Produce Slicer", owned by the Applicant and which is also incorporated herein by reference in its entirety.

Despite improvements in slicing provided by the Applicant, the inventors have further discovered that distinct challenges exist in such slicing machines as the width of the produce slice decreases. One particularly challenging produce slicing application is that of one eighth inch thick onion slices. While not so limited to this example, the relative hardness of onions compared to other types of produce (e.g. comparatively softer tomatoes, lettuce, or cucumbers) and the small width of the slices presents a particular challenge in the industry. The small width of the slices requires more blades per piece of produce and each blade in contact with the produce increases the surface area contact between blades and the produce, increasing the force needed to slice the piece of produce. Under this force, the blades and/or the fins of the pusher naturally deflect during slicing. On the other hand, the fins of the pusher must maintain a sufficient thickness and surface area so as to push the produce rather than slice into the produce themselves. The thickness of the pusher fins combined with the narrow spacing between each of the blades (and between adjacent fins of the pusher) provides minimum space to accommodate lateral deflection in either the blades or the pusher fins. In addition, the pusher fins must stay in alignment with the blades of the corresponding blade set or sets within the overall mechanical system of the slicer.

Therefore, solutions to improve the slicing coordination between the pusher and the blades are desirable in the field.

BRIEF DISCLOSURE

An exemplary embodiment of a produce pusher may be used in a produce slicer. The produce pusher includes a T-bracket. The T-bracket includes a base plate that generally extends in a plane in a width dimension and a depth dimension. A projection extends in the depth dimension and extends away from the base plate in a height dimension. A plurality of fins are in contact with the base plate. Each fin of the plurality extends in the depth dimension and extends away from the base plate in the height dimension. A first fin and a second fin of the plurality of fins extend parallel to and in contact with the projection. A third fin of the plurality of fins extends parallel to the first fin on a side of the first fin opposite the projection. A fourth fin of the plurality of fins extends parallel to the second fin on a side of the second fin opposite the projection. A plurality of spacers are in contact with the base plate. Each spacer of the plurality of spacers extends in the depth dimension and extends away from the base plate in the height dimension. A first spacer of the plurality of spacers is positioned between the first and third fins and a second spacer of the plurality of spacers is positioned between the second and fourth fins. A first fastener extends through the plurality of fins, the plurality of spacers, and the projection. The first fastener simultaneously applies a first compressive force to the first fin, the third fin, and the first spacer against the projection and applies a second compressive force to the second fin, the fourth fin, and the second spacer against the projection.

In further exemplary embodiments of the produce pusher, the projection, the plurality of fins, and the plurality of spacers all extend across the base plate for the depth dimension of the base plate. The projection may be centered relative to the base plate. The projection may be unitary to the base plate. The base plate may further include depressions that extend across the base plate in the depth dimension at the intersection between the projection and the base plate.

Each of the plurality of fins and each of the plurality of spacers may include flat engagement surfaces configured for engagement with the base plate. Each of the spacers may include rounded outer corners at ends of the spacers opposite the flat engagement surfaces. The plurality of fins may include a contour in each of the plurality of fins at an end of each fin opposite the flat engagement surface of each fin. The plurality of fins and the plurality of spacers may all be parallel to the projection and may be alternatingly stacked outwards from the projection to an extent of the base plate in the width dimension. The first fastener may extend through a first set of holes through each of the plurality of fins, the plurality of spacers, and the projection. A second fastener may extend through a second set of holes through each of the plurality of fins, the plurality of spacers, and the projection. The first and second fasteners may be threaded fasteners and further each fastener includes a threaded nut wherein the first and second fasteners each apply the first and second compressive forces. A maximum slice thickness may be defined as the combined width of one spacer of the plurality of spacers and an adjacent one fin of the plurality of fins. The maximum slice thickness may be less than or equal to ¼ inch. The maximum slice thickness may be less than or equal to ⅛ inch.

An exemplary embodiment of a produce slicer includes a support frame. A pusher head is removably connected to the support frame and the pusher head includes at least one produce pusher. The at least one produce pusher includes a T-bracket. The T-bracket includes a base plate that generally extends in a plane in a width dimension and a depth dimension. A projection extends in the depth dimension and extends away from the base plate in a height dimension. A plurality of fins are in contact with the base plate. Each fin of the plurality extends in the depth dimension and extends away from the base plate in the height dimension. A first fin and a second fin of the plurality of fins extend parallel to and in contact with the projection. A third fin of the plurality of fins extends parallel to the first fin on a side of the first fin opposite the projection. A fourth fin of the plurality of fins extends parallel to the second fin on a side of the second fin opposite the projection. A plurality of spacers are in contact with the base plate. Each spacer of the plurality of spacers extends in the depth dimension and extends away from the base plate in the height dimension. A first spacer of the plurality of spacers is positioned between the first and third fins and a second spacer of the plurality of spacers is positioned between the second and fourth fins. A first fastener extends through the plurality of fins, the plurality of spacers, and the projection. The first fastener simultaneously applies a first compressive force to the first fin, the third fin, and the first spacer against the projection and applies a second compressive force to the second fin, the fourth fin, and the second spacer against the projection. A blade assembly is removably connected to the support frame. The support frame facilitates relative movement between the pusher head and the blade assembly to slice a piece of produce positioned between the pusher head and the blade assembly.

In further exemplary embodiments of the produce slicer, a target area is located on the blade assembly and the piece of produce is positioned on the target area with the produce pusher in alignment with the target area. The target area may be one of a plurality of target areas on the blade assembly and the at least one produce pusher is a plurality of produce pushers of the pusher head, each of the produce pushers in alignment with one of the target areas. The pusher head may be movable relative to blade assembly to push the at least one piece of produce through blades of the blade assembly. The blade assembly may include a plurality of blades and each of the blades of the blade assembly is positioned in alignment with a spacer of the plurality of spacers of the produce pusher. The blade assembly and the produce pusher may be configured for the fins of the produce pusher to extend between the blades of the blade assembly. The blade assembly may include two offset blade sets, and blades from alternating blade sets are in alignment with adjacent spacers of the produce pusher. The projection, the plurality of fins, and the plurality of spacers all extend across the base plate for the depth dimension of the base plate and the plurality of fins and the plurality of spacers are all parallel to the projection and are alternatingly stacked outwards from the projection to an extent of the base plate in the width dimension.

An exemplary embodiment of a produce pusher may be used in a produce slicer. The produce pusher includes a T-bracket. The T-bracket includes a base plate that generally extends in a plane in a width dimension and a depth dimension. A projection is in unitary construction with the base plate. The projection is centered relative to the base plate and extends across the base plate in the depth dimension and extends away from the base plate in a height dimension. Depressions extend across the base plate in the depth dimension at an intersection between the projection and the base plate. A plurality of fins each have a flat engagement surface in contact with the base plate. Each fin of the plurality extends across the base plate in the depth dimension and extends away from the base plate in the height dimension. A first fin and a second fin of the plurality of fins extend parallel to and in contact with the projection. A third fin of the plurality of fins extends parallel to the first fin on a side of the first fin opposite the projection. A fourth fin of the plurality of fins extends parallel to the second fin on a side of the second fin opposite the projection. A plurality of spacers each have a flat engagement surface in contact with the base plate. Each spacer of the plurality of spacers extends across the base plate in the depth dimension and extends away from the base plate in the height dimension. A first spacer of the plurality of spacers is positioned between the first and third fins and a second spacer of the plurality of spacers is positioned between the second and fourth fins. The plurality of spacers and the plurality of fins are all parallel to the projection and are alternatingly stacked outwards from the projection to an extent of the base plate in the width dimension. A first fastener extends through a first set of holes through the plurality of fins, the plurality of spacers, and the projection. A second fastener extends through a second set of holes through the plurality of fins, the plurality of spacers, and the projection. The first fastener and the second fastener simultaneously apply a first compressive force to the first fin, the third fin, and the first spacer against the projection and apply a second compressive force to the second fin, the fourth fin, and the second spacer against the projection.

DETAILED DISCLOSURE

Figure 1:
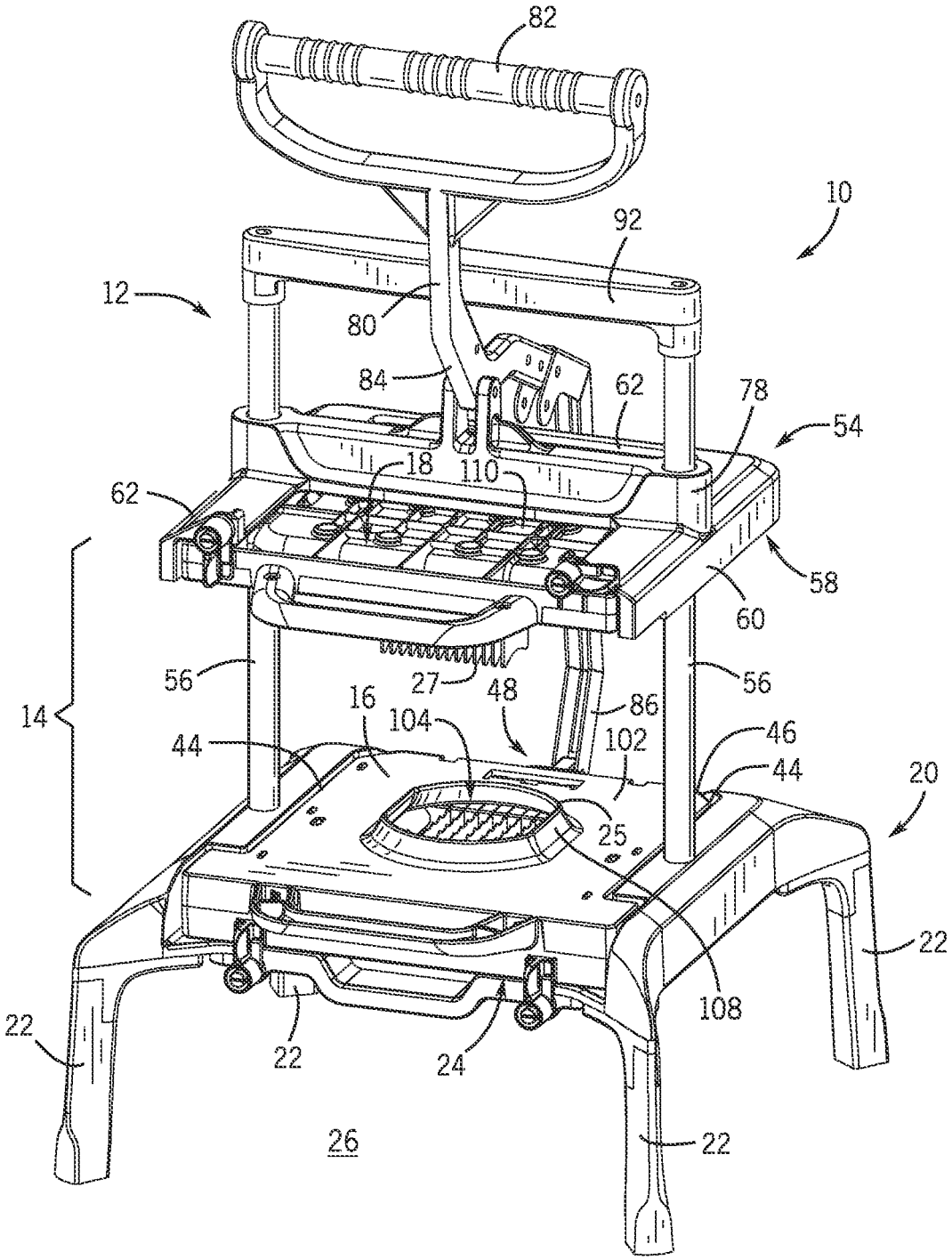
FIG. 1 depicts an exemplary embodiment of a produce slicer.

FIG. 1 is an exemplary embodiment of a produce slicer 10. While exemplary embodiments of the pusher as disclosed herein may be used with the produce slicer 10 depicted in FIG. 1, it will be recognized that other forms of produce slicers, may also use the disclosed pusher. The produce slicer 10 includes a frame 12. A blade cartridge 14 is received within the frame 12. The blade cartridge 14 includes a blade assembly 16 and a pusher head 18. In an exemplary and non-limiting embodiment, the blade assembly 16 and the pusher head 18 of the blade cartridge 14 are slidingly received into the frame 12. The frame 12 facilitates movement of the pusher head 18 relative to the blade assembly 16 such that the pusher head 18 is partially received within the blade assembly 16. The pusher as disclosed herein, incorporated with a produce slicer, for example produce slicer 10, may exemplarily be used to cut any of a variety of produce, including, but not limited to: fruits, vegetables, meats, seafood, tofu, cheese and other foods. However, as previously noted, embodiments of the pusher as disclosed herein may have particular utility when used to cut relatively hard vegetables into relatively thin slices. While embodiments are exemplarily described in further detail herein with specific reference to onions it will be recognized that the range of available foods to be cut is not so limited.

The frame 12 includes a frame base 20 which itself may include at least one leg 22. In an exemplary embodiment, the frame base 20 includes four legs, each extending from a corner of the frame base 20.

The frame base 20 further includes a support surface 24. The support surface 24 as described in further detail herein supports the blade assembly 10. The base 20 defines a product receiving area 26 between the legs 22 and below the support surface 24 wherein a produce receiving container (not depicted) may be positioned below the support surface 24 to receive sliced produce after operation of the produce slicer 10.

As will be described in further detail herein, the frame base 20 is configured to receive, hold, and support the blade assembly 16. The frame base 20 further includes lateral walls 44 and a rear wall 46 that may extend vertically from the support surface 24. The lateral walls 44 and the rear walls 46, together with the support surface 24 and cut-outs 34, define a blade assembly receiving area 48.

The frame 12 further includes a pusher assembly 54 at least partially movably secured to the frame base 20. The pusher assembly 54 includes rails 56 which extend from the frame base 20. The pusher assembly 54 further includes a head receiver 58. The head receiver 58 is exemplarily slidingly secured to the rails 56 and is configured as described in further detail herein to receive a pusher head 18 of a blade cartridge 14. The head receiver 58 includes laterally opposed guide arms 60 and a rear guide 62. The guide arms 60 and rear guide 62 include lower plates and upper plates. The lower plates and upper plates of the guide arms 60 and rear guide 62 define a pusher head receiving area configured to receive a pusher head 18, and is exemplarily configured to slidingly receive the pusher head 18. The pusher head 18 is configured with one or more pushers 27 that correspond to a target area 25 of the blade assembly 16.

The head receiver 58 further includes a force bar 78 that extends between the laterally opposed guide arms 60. The force bar 78 operates to translate force from an arm 80 connected to a handle 82 which movably engages the force bar 78. In an exemplary embodiment, the arm 80 has an inverted "L" shape to generally orient the handle 82 in a horizontal orientation, while it will be recognized that other orientations may be used including a more vertical arm 80, resulting in a vertically-oriented handle 82. In the exemplary embodiment depicted in FIG. 1, the arm 80 is pivotably secured to the force bar 78 at an arm pivot 84. The arm pivot 84 translates generally downward force applied to the handle 82 by a user to the force bar 78 to direct the head receiver 58 downward towards the frame base 20 during operation of the produce slicer 10. In an exemplary embodiment, the arm 80 is further secured to a body 86 by a body pivot and the body 86 is secured to the base 20 at a base pivot. The pivoted connection of the body 86 between the base 20 at the base pivot and the arm 80 at the body pivot reduces the overall operable footprint of the device such that the arm 80, body 86, or body pivot do not extend laterally past the rear leg 22 of the base 20. In exemplary embodiments, this enables the produce slicer 10 to be positioned with the rear legs 22 engaging a wall or kitchen station divider enabling efficient use of workstation counter space. Embodiments of the combination of arm 80, arm pivot 84, body 86, body pivot, and base pivot further limit the extent to which the handle 82 extends beyond the lateral dimension of the front legs 22 during operation of the produce slicer 10 and such that embodiments of the produce slicer 10 may be operated by a food preparation worker with minimized impact to the movement of other workers past the worker operating the produce slicer.

The blade assembly 16 includes a blade cover 102 and at least one blade set 104. The blade cover 102 temporarily includes a target ring 108 that defines the target area 25 above the blade set 104. Each blade set 104 comprises a plurality of blades, and in exemplary embodiments, the blade assembly 16 includes multiple blade sets 104. In such embodiments, by stacking staggered arrangements of blade sets, a smaller intra-blade distance can be made while fractionally reducing the surface area of the blades entering the produce at a single point in time. As an example, if two blade sets are used then half of the cutting surface area pierces the produce/produce skin at a time, while if three blade sets are used, one-third of the cutting surface area may be used. It will be recognized that the distance between adjacent offset blades corresponds to a desired thickness of the slices produce, while offsetting of the blades further reduces the cutting surface area engaged by the skin or surface of the produce at one time which promotes slicing.

Specifically referring to the pusher head 18, the pusher head 18 is received within the pusher head receiving area of the frame 12. The pusher head 18 exemplary includes a produce pusher 27 that is secured to the body 110 of the pusher head 18. Embodiments of produce pushers 27 will be described in further detail herein.

From FIG. 1 it will be recognized that the exemplary embodiment of a produce slicer 10 depicted in FIG. 1, or another similar type of produce slicer as will be recognized by a person of ordinary skill in the art is a mechanical (or electromechanical) system in which a large number of components are connected to one another and components move relative to one another. Thus, the produce slicer 10 forms a system wherein the fins of the pusher must align relative to the blades of the blade sets such that each fin can nest between the blades of the blade sets as the pusher 27 pushes the produce to be sliced through the blade sets 104.

Figure 2:
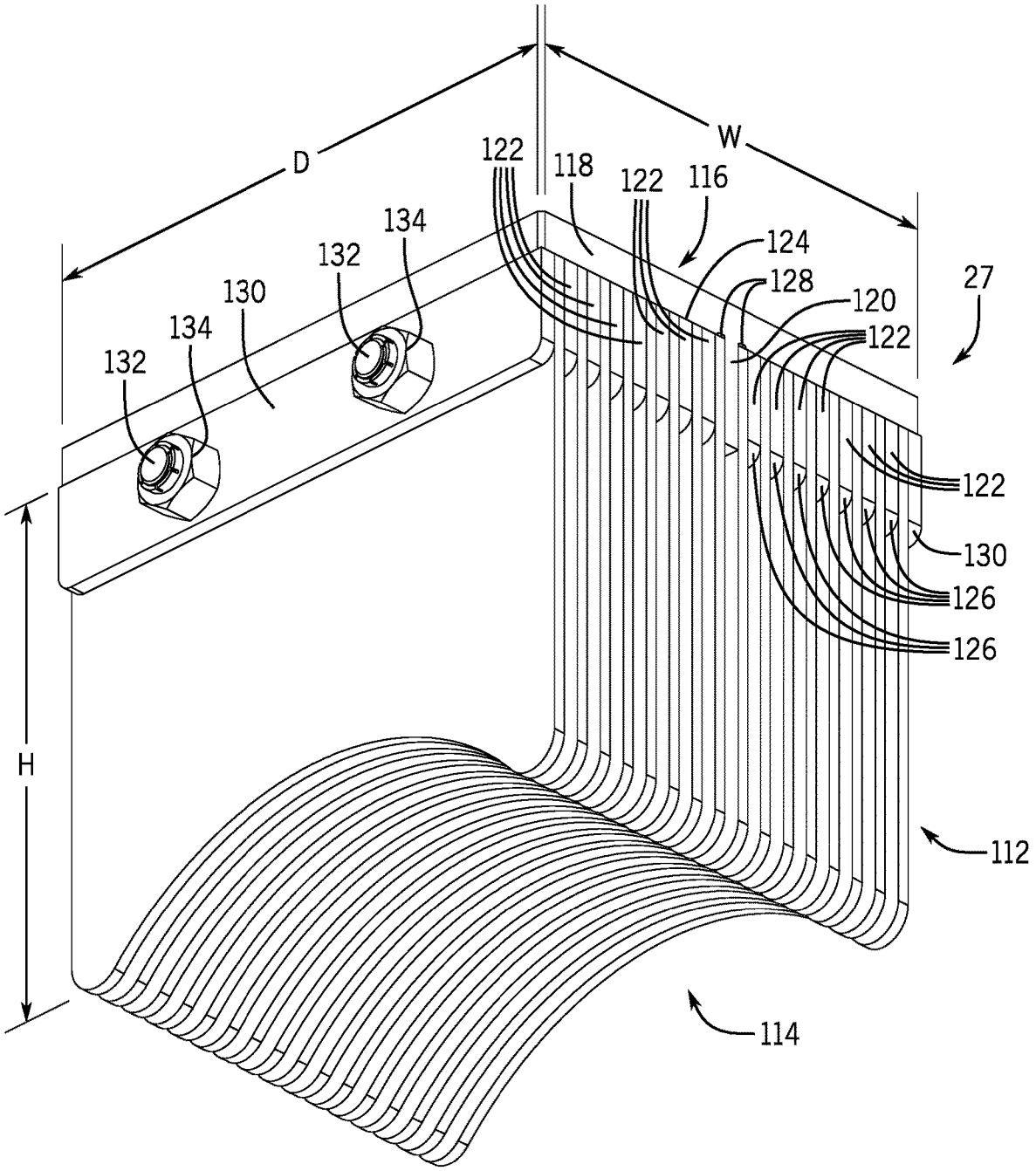
FIG. 2 is a perspective view of an exemplary embodiment of a produce pusher.

FIG. 2 is a perspective view of a produce pusher 27. As noted previously, the produce pusher 27 depicted in FIG. 2 and as described herein may be particularly useful in slicing relatively thin slices of relatively hard produce, for example one eighth inch slices of onion. While a variety of measurements of firmness are recognized or used, one such measurement is in the units $kgf/cm^2$. Testing protocols may vary, but typically measure the force over a surface area required to achieve a particular depth of depression (e.g. between 1 mm-5 mm). Onions may exemplarily have a firmness of 10-15 $kgf/cm^2$, while tomatoes are often 5 $kgf/cm^2$ or less. It will be recognized that these ranges are approximate and exemplary and values outside of this range may occur based particular testing protocol, produce variety, age, and holding conditions. Specifically, by this consideration, onions are more firm than tomatoes. However, it will be recognized from the above disclosure that produce will exhibit different firmness which has been found to have an impact on slicing. While the exemplary embodiment of one eighth inch slices of onion used herein, other slicing uses may include slice dimensions of three sixteenth inch or one quarter inch, while the produce pusher 27 as described herein may be particularly effective for such dimensions, this is not limiting on the slicing dimensions with which the produce pusher 27 may be used. Embodiments of the produce pusher 27 disclosed herein may be used with thicker slices of produce as well. Similarly, the produce pusher 27 as described herein is not so limited to solely use with slicing onions, but may also be used in cutting other relatively hard vegetables, for example, potatoes, beets, or carrots. A person of ordinary skill in the art will also recognize that the produce pusher may still be capable of slicing softer produce, for example tomatoes or cucumbers.

The produce pusher 27 is constructed with a T-bracket 116 and a plurality of fins 112. The fins 112 extend from the T-bracket 116 in a height dimension (H). The fins 112 extend along the T-bracket 116 along a depth dimension (D). The fins 112 are evenly spaced from one another along a width dimension (W) at the desired slicing thickness. It will be recognized therefore that different produce pushers 27 may be constructed to produce slices of different thicknesses. The fins 112 themselves have a thickness in the width dimension that is less than the thickness of the slices of produce for which the produce pusher 27 is configured to slice, that is less than the distance between adjacent blades between which the fins 112 are to pass. However, it will be recognized that the thickness of the fins 112 is further balanced between being sufficiently thick so as to provide a surface area that does not damage the produce, but that is minimized in order to maximize the tolerance for deflection of the blades and the fins during slicing. It will be recognized that, with the improved deflection resistance provided with the disclosed produce pusher, embodiments may provide advantageously thicker fins.

The fins 112 are exemplary shaped with a contour 114 so as to accommodate a piece of produce and to help keep the piece of produce centered on the associated blade set 104. While the contour 114 is depicted as being the same across each of the fins 112 and extending in the depth dimension of the produce pusher 27, in another example, adjacent fins 112 may have differing individual contours 114 such as to provide a contour across the plurality of fins in the width dimension of the produce pusher. In a still further example, the contours 114 may extend across the produce pusher in both the depth dimension and the width dimension.

The produce pusher 27 includes a T-bracket 116 that represents a departure from prior produce pusher solutions. The T-bracket 116 includes a base plate 118 that generally extends in the width and depth dimensions and a projection 120 that extends in the depth dimension and the height dimension from the base plate 118. The projection 120 is exemplarily perpendicular to the base plate 118 and the T-bracket is formed as a unitary structure with the base plate 118. In exemplary embodiments, the T-bracket 116 may be formed as an extrusion, while in other embodiments, the T-bracket may be cast or milled. A person of ordinary skill in the art will recognize other manufacturing processes suitable for constructing a T-bracket 116 as will be described in further detail herein.

The projection 120 exemplarily extends the entire depth dimension of the base plate 118 in parallel to the fins 112 and forms a single point of connection between the fins 112 and the base plate 118 as will be described in further detail herein. While in other embodiments, the projection 120 may be offset to one side or the other along the width dimension of the base plate 118, in the embodiments depicted, the projection is centered along the base plate 118 at an equal distance from either edge of the base plate in the width dimension.

The produce pusher 27 further includes a plurality of spacers 122 that are positioned between each of the respective fins 112. The spacers 122 are exemplarily constructed in similar dimensions as the projection 120 and the spacers 122 exemplarily also extend across the depth dimension of the base plate 118. The spacers 122, and the projection 120, exemplarily have a thickness that is complementary to the thickness of the fins 112 such as to align each spacer 122 with a respective blade of the complementary blade set for use with the produce pusher 27.

The spacers 122 have a flat engagement surface 124 that is configured to be held against the base plate 118. The spacers 122 further exemplarily include rounded outer corners 126 at the end of the spacers opposite the flat engagement surface 124. The combination of the flat engagement surface 124 held securely against the base plate 118 of the T-bracket 116 and the rounded outer corners 126 of each of the spacers 122 help to provide a produce pusher structure that improves cleanability with few crevices in which food material may become trapped.

The base plate 118 further includes depressions 128 located at either side of the projection 120. In an exemplary embodiment, the depressions 128 provide additional space at the transition between the base plate 118 and the projection 120 such that the fins 112 immediately adjacent the projection 120 can be held flush against the sides of the projection 120. It was discovered by the inventors that if the depressions 128 are not provided, that the corner at the transition between the base plate 118 and the projection 120 may be rounded and can obstruct proper positioning of the fins 112 immediately adjacent to the projection 120.

The spacers 122 help to maintain the predetermined distance between each of the fins 112. The center-to-center distance between the adjacent fins 112 defines a maximum thickness of a slice of the produce cut using the produce pusher 27. In another example, the combined width of one fin 112 and one adjacent spacer 122 also defines the maximum thickness of a slice of produce cut using the produce pusher 27. However, the fins 112 and the spacers 122 (and similarly the projection 120) may not be the same width. While increased width of the fins 112 increases the surface area across which the force of the pusher is distributed, thus reducing potential damage to the produce by the produce pusher, greater width of the spacers 122 provide additional tolerance to flexion or deformation of the fins 112 or the blades during cutting. However, embodiments of the produce pusher 27 as disclosed herein may provide improved tolerance in the positioning of the fins 112 and deflection resistance of the fins 112. The fins 112 may thus be the same thickness in the width dimension as the spacers 122, or may be thicker than the spacers 122. In use, this improved tolerance and operation can provide more effective cutting of relatively hard produce, for example onions, into relatively thin slices, for example ¼ inch, 3/16 inch, or ⅛ inch slices.

The plurality of fins 112 and the plurality of spacers 122 are arranged in parallel to one another and in parallel to the projection 120. The plurality of fins 112 and the plurality of spacers 122 are arranged in an outwardly extending alternating stack from the projection 120 in the width dimension of the base plate 118, exemplarily to the width edges 140 of the base plate 118.

Figure 3:
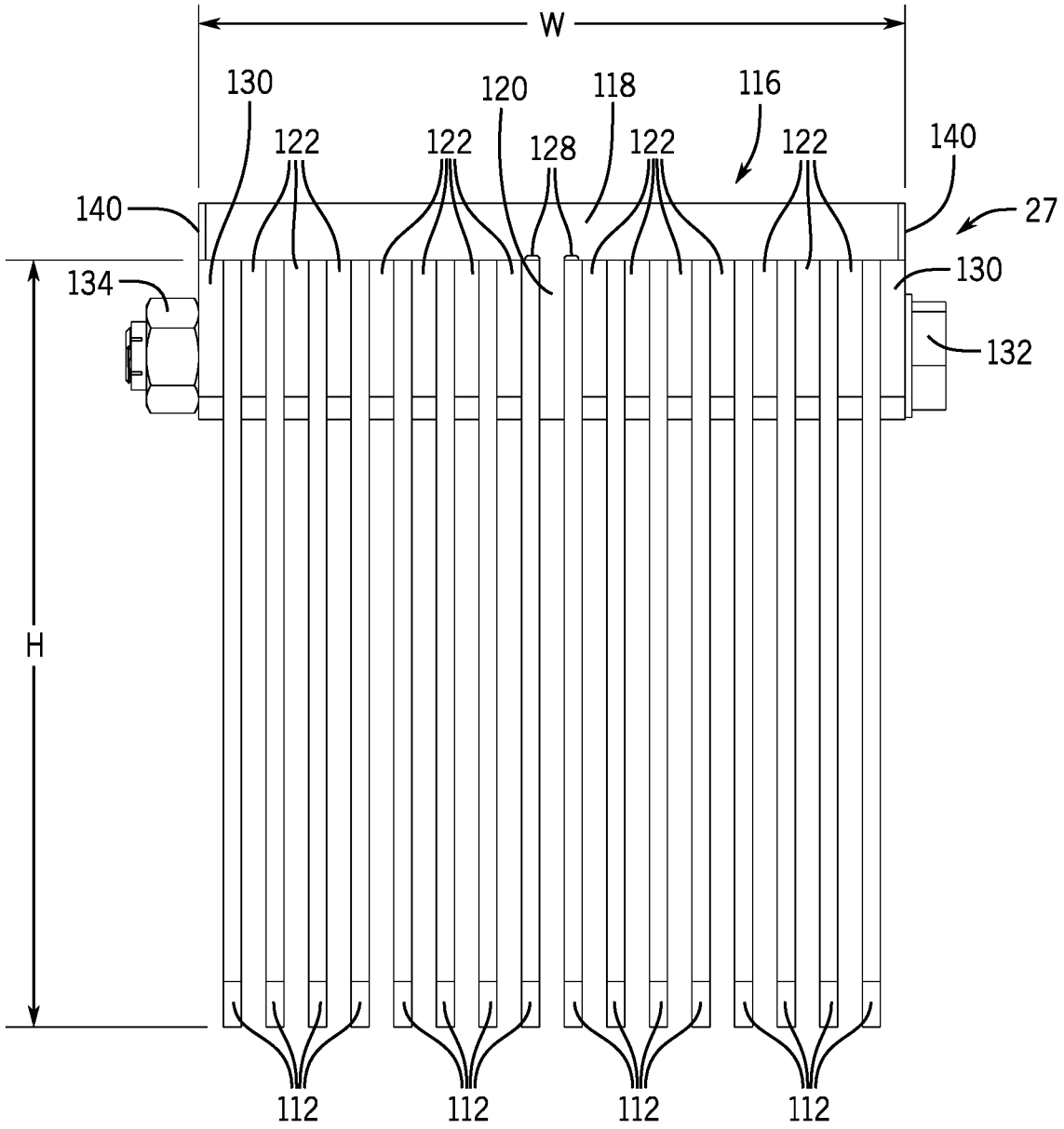
FIG. 3 is a front view of an exemplary embodiment of a produce pusher.
Figure 4:
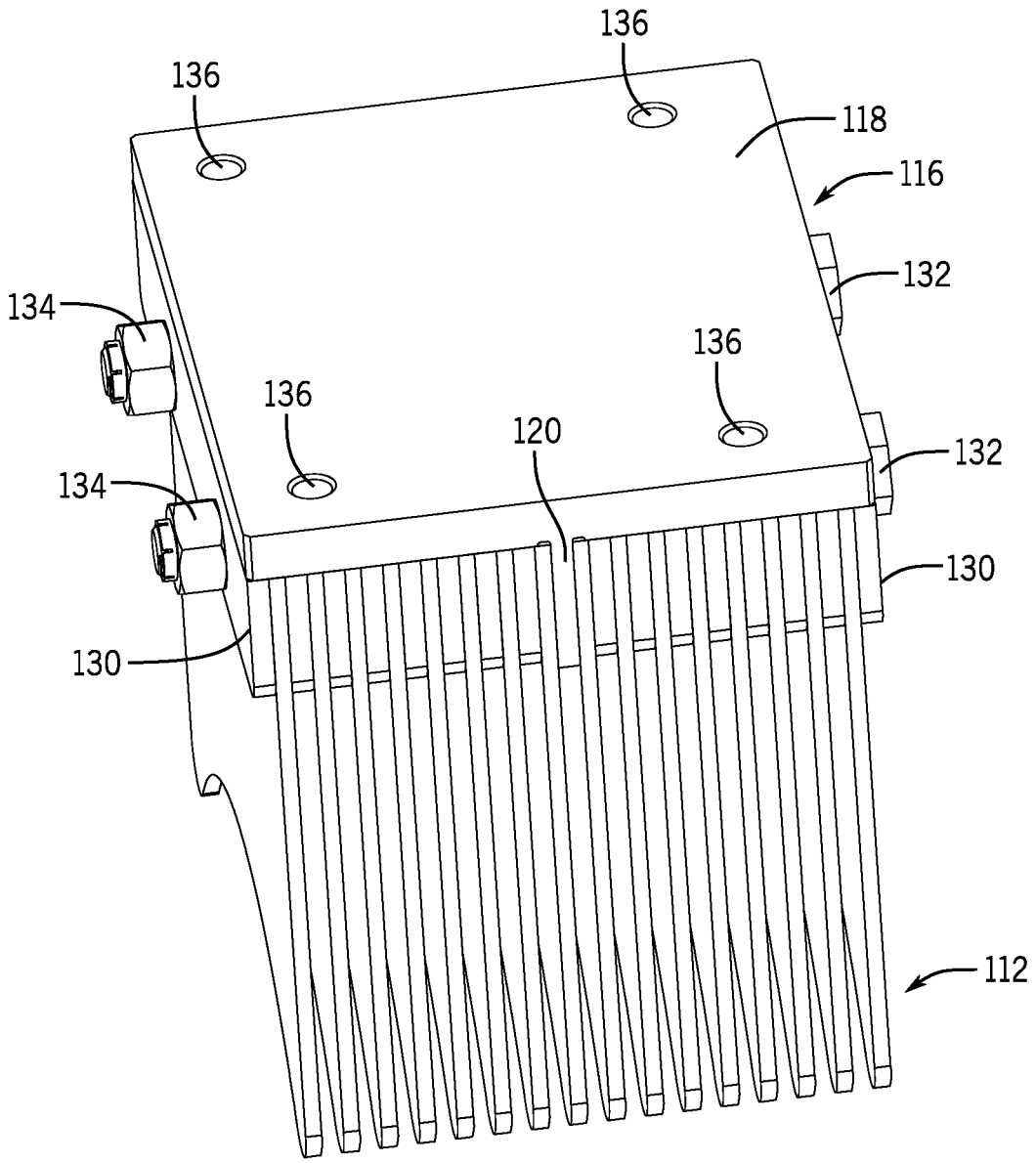
FIG. 4 is a top perspective view of an exemplary embodiment of a produce pusher.

The produce pusher 27 may further include end plates 130 in an exemplary embodiment. The end plates 130 may be constructed in the same exemplary manner as the spacers 122, as depicted in FIGS. 2-4, although in other embodiments, the end plates 130 may take other shapes or forms while remaining within the scope of the present disclosure. The end plates 130 are exemplarily dimensioned to be the same length as the base plate 118. Additionally, the base plate 118 is configured and dimensioned such that the parameter and area of the base plate 118 matches the parameter and area of the combined components of the end plates 130, spacers 122, projection 120, and fins 112, such that in an exemplary embodiment the respective parameters of these components are the same as shown in FIGS. 2 and 4. In examples, the end plates 130 may be equivocal to spacers 122 positioned to the exterior of the outermost fins 112 on either side of the projection 120. In other examples, the produce pusher may terminate with spacers 122 or fins 112 in alignment with the width edges 140 of the base plate 118.

It will be recognized that while not depicted, the end plates 130, spacers 122, fins 112, and projection 120 all include one or more through holes, through which fasteners, for example, threaded fasteners, such as bolts 132, are secured. The bolts 132 are held in place at the ends against the end plate 130 by nuts 134.

Tightening of the bolts 132/nuts 134 places a compressive retaining force against the end plates 130 (or against fins 112 arranged at the base plate edges 140). The compressive retaining force translated through the spacers 122 and fins 112 between the two end plates 130. Because the T-bracket 116 includes an integral projection 120 arranged at the center of this system of components of the produce pusher 27, the compressive forces of the bolts 132/nuts 134 are tightened against the end plates 130 create two retention systems including half of the fins 112 and half of the spacers 122. The one or more fastener thus simultaneously produces two compressive forces inward from the respective end plates 130 against the projection 120. Because the projection 120 is fixed and integral with the base plate 118 to form the T-bracket 116, each half of the fin assembly between a respective end plate 130 and the projection 120 behaves in a relatively independent manner. This is important as the fins 112 are held in tension and held in position across a distance that is only half of the width dimension of the produce pusher 27, for example from one end plate 130 to the projection 120. In this manner any error in the position or alignment of the fins 112, for example due to deflection during cutting a piece of hard produce, is only accumulated across half of the produce pusher width, and such accumulation occurs across half the distance in two different systems. This halves and localizes the accumulated error within both of the fin systems thereby preventing or eliminating a large accumulation of error in fin positioning across the entire width of the produce pusher 27. Additionally, as was previously described, during use the fins 112 may flex or move and this movement may also be accumulated within the produce pusher system. Again, as the fins 112 are arranged in two fin systems, this accumulation of intra-slicing error is halved and localized between the two systems. Therefore, a produce pusher 27 as shown and described herein can provide more reliable fin positioning during slicing of produce by creating a produce pusher system in which position error or movement between fins is reduced and spread among these two smaller and more localized fin systems.

Figure 5:
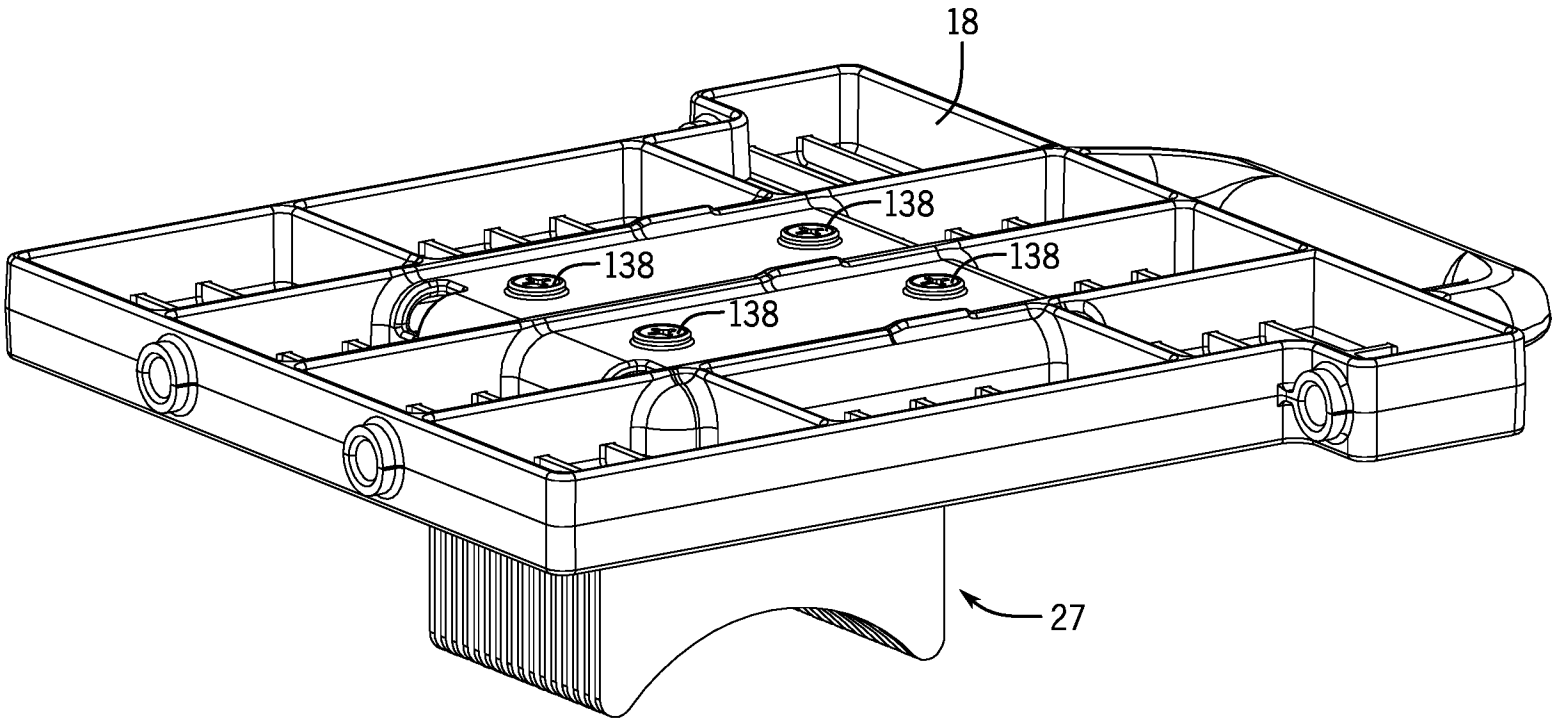
FIG. 5 is a perspective view of a pusher head.

FIG. 3 is an exemplary front view and FIG. 4 is an exemplary top perspective view of the produce pusher 27. The figures provide additional views of the produce pusher 27 as described above. It will be recognized that the produce pusher 27 may be constructed of a variety of materials including, but not limited to stainless steel or aluminum. It will also be recognized that some or all of the produce pusher 27 may be constructed of plastic or polymer materials or other materials as will be recognized and otherwise deemed suitable by a person of ordinary skill in the art. FIG. 4 depicts a plurality of receiver holes 136 exemplarily through the base plate 118. Since the fins 112 and the spacers 122 are held firmly against the opposite side of the base plate 118 than shown in FIG. 4, the receiver holes 136 may exemplarily be blind holes and configured to receive machine screws 138 which are used in an exemplary embodiment to secure the produce pusher 27 to the body 110 of a pusher head 18. This is exemplarily depicted in FIG. 5. In another embodiment, the receiver holes 136 extend completely through the base plate 118, but because of the positioning of the fins 112 and the spacers 122 across the depth and width dimensions of the base plate 118.

Figure 6:
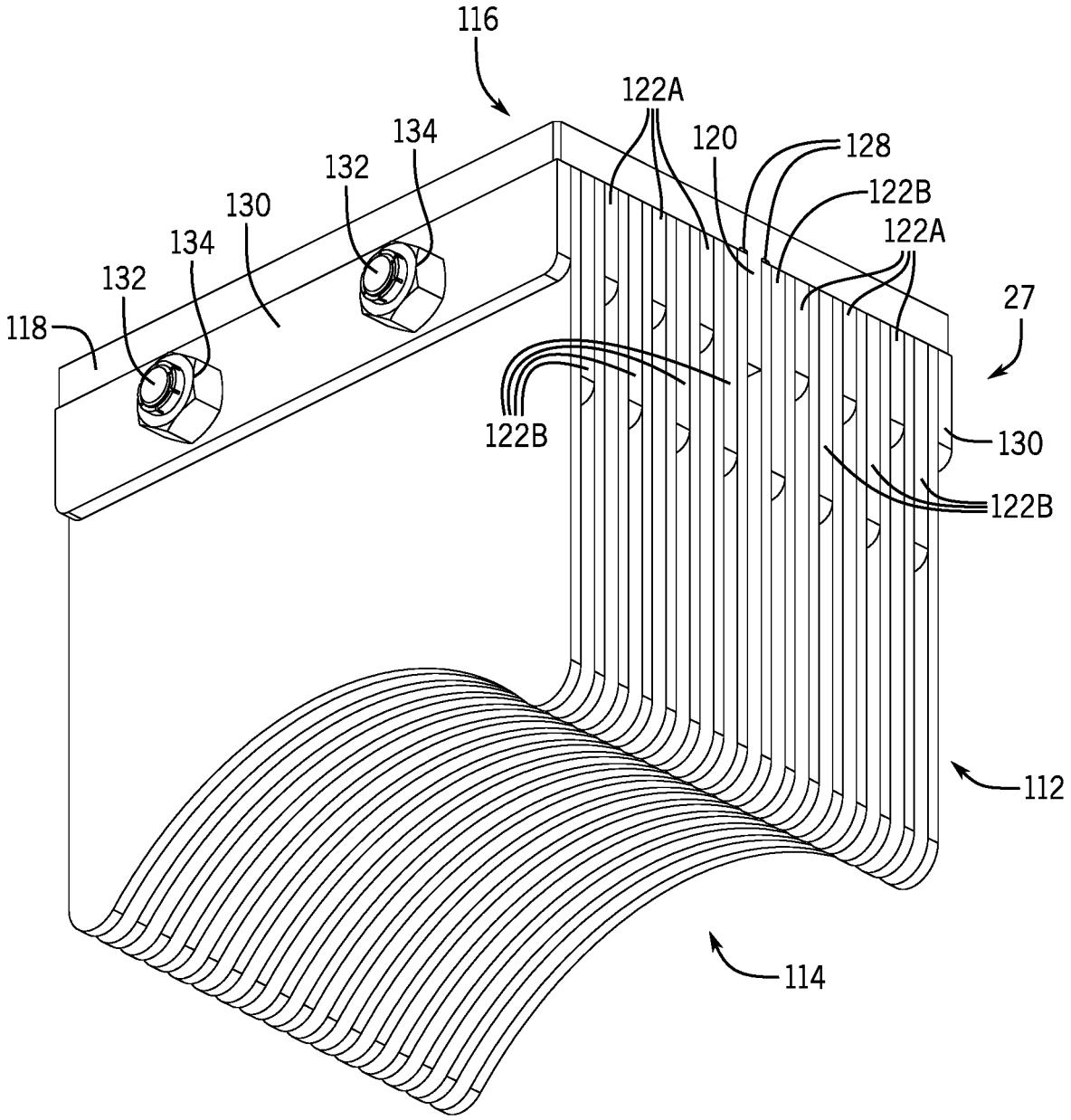
FIG. 6 is a perspective view of an additional embodiment of a produce pusher.

FIG. 6 depicts an additional example of a produce pusher 27. The produce pusher 27 includes many of the same features as described above with respect to FIGS. 2-4, and it will be recognized that like reference numerals are used in FIG. 6 to identify like features as described above with respect to FIGS. 2-4. In the produce pusher 27 of FIG. 6, spacers 22*a* and 22*b* are arranged in different lengths and alternate in their position between each of the fins 112. In an exemplary embodiment, as previously noted, the corresponding blade assembly for use in the produce slicer may include two blade sets stacked in an offset manner. In such an embodiment as depicted in FIG. 6, the spacers 122*a* and 122*b* may be dimensioned such that the spacers 122*a* and 122*b* extend permissibly close to the corresponding blades when the pusher head is in a final cut position with the fins 112 nested between the blades of the blade assembly. Therefore, it would be recognized that exemplarily the shorter spacers 122*a* correspond to blades of the upper blade set of the blade assembly while the longer spacers 122*b* correspond to blades of the lower blade set. In an exemplary embodiment, this maximizes the distance along which the spacers 122*a*, 122*b* are able to be positioned along the fin 112 while not interfering with the blades of the corresponding blade assembly.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A produce pusher for use in a produce slicer, the produce pusher comprising:

a T-bracket comprising:

a base plate generally extending in a plane in a width dimension and a depth dimension; and a projection unitary with the base plate and centered relative to the base plate, the projection extending in the depth dimension and extending away from the base plate in a height dimension;

a plurality of fins, each fin of the plurality in contact with the base plate, each fin of the plurality extending in the depth dimension and extending away from the base plate in the height dimension, wherein a first fin and a second fin of the plurality of fins extend parallel to and in contact with the projection, wherein a third fin of the plurality of fins extends parallel to the first fin on a side of the first fin opposite the projection and a fourth fin of the plurality of fins extends parallel to the second fin on a side of the second fin opposite the projection;

a plurality of spacers, each spacer of the plurality of spacers in contact with the base plate, each spacer of the plurality of spacers extending in the depth dimension and extending away from the base plate in the height dimension, wherein a first spacer of the plurality of spacers is positioned between the first and third fins and a second spacer of the plurality of spacers is positioned between the second and fourth fins; and a first fastener that extends through the plurality of fins, the plurality of spacers and the projection, wherein the first fastener simultaneously applies a first compressive force to the first fin, the third fin, and the first spacer against the projection and applies a second compressive force to the second fin, the fourth fin, and the second spacer against the projection;

wherein the projection, the plurality of fins, and the plurality of spacers all extend across the base plate for the depth dimension of the base plate; and wherein the base plate further comprises depressions that extend across the base plate in the depth dimension at an intersection between the projection and the base plate.

2. The produce pusher of claim 1, wherein each fin of the plurality of fins and each spacer of the plurality of spacers comprises a flat engagement surface configured for engagement with the base plate.

3. The produce pusher of claim 2, wherein each spacer of the plurality of spacers comprises rounded outer corners at an end of the spacer opposite the flat engagement surface, and the plurality of fins comprise a contour in each of the plurality of fins at an end of each fin opposite the flat engagement surface of each fin.

4. The produce pusher of claim 1, wherein the width dimension of the base plate extends between a first edge of the base plate and a second edge of the base plate, and the projection is centered between the first edge and the second edge and further comprising:

wherein the first fastener is configured to apply the first compressive force against the first fin, the first spacer and the third fin in a direction from the first edge of the base plate towards the projection; and wherein the first fastener is configured to apply the second compressive force against the second fin, the second spacer and the fourth fin in a direction from the second edge of the base plate towards the projection.

5. The produce pusher of claim 1, wherein the first fastener is configured to secure the plurality of fins and the plurality of spacers to the T-bracket at the projection.

6. The produce pusher of claim 1, further comprising a second fastener, wherein the first fastener extends through a first set of holes through each of the plurality of fins, the plurality of spacers, and the projection and the second fastener extends through a second set of holes through each of the plurality of fins, the plurality of spacers, and the projection.

7. The produce pusher of claim 6, wherein the first and second fasteners are threaded fasteners further each comprising a threaded nut wherein the first and second fasteners each apply the first and second compressive forces.

8. The produce pusher of claim 1 wherein a maximum slice thickness is defined as the combined width of one spacer of the plurality of spacers and an adjacent one fin of the plurality of fins; wherein the maximum slice thickness is less than or equal to ¼ inch.

9. The produce pusher of claim 8, wherein the maximum slice thickness is less than or equal to ⅛ inch.

10. A produce slicer comprising:

a support frame;

a pusher head removably connected to the support frame, the pusher head comprising at least one produce pusher comprising:

a T-bracket comprising:

a base plate generally extending in a plane in a width dimension and a depth dimension; and a projection unitary with the base plate and centered relative to the base plate, the projection extending in the depth dimension and extending away from the base plate in a height dimension;

a plurality of fins, each fin of the plurality in contact with the base plate, each fin of the plurality extending in the depth dimension and extending away from the base plate in the height dimension, wherein a first fin and a second fin of the plurality of fins extend parallel to and in contact with the projection, wherein a third fin of the plurality of fins extends parallel to the first fin on a side of the first fin opposite the projection and a fourth fin of the plurality of fins extends parallel to the second fin on a side of the second fin opposite the projection;

a plurality of spacers, each spacer of the plurality of spacers in contact with the base plate, each spacer of the plurality of spacers extending in the depth dimension and extending away from the base plate in the height dimension, wherein a first spacer of the plurality of spacers is positioned between the first and third fins and a second spacer of the plurality of spacers is positioned between the second and fourth fins; and a first fastener that extends through the plurality of fins, the plurality of spacers and the projection, wherein the first fastener simultaneously applies a first compressive force to the first fin, the third fin, and the first spacer against the projection and applies a second compressive force to the second fin, the fourth fin, and the second spacer against the projection;

wherein the projection, the plurality of fins, and the plurality of spacers all extend across the base plate for the depth dimension of the base plate; and wherein the base plate further comprises depressions that extend across the base plate in the depth dimension at an intersection between the projection and the base plate; and a blade assembly removably connected to the support frame, wherein the support frame facilitates relative movement between the pusher head and the blade assembly to slice a piece of produce positioned between the pusher head and the blade assembly.

11. The produce slicer of claim 10, further comprising a target area on the blade assembly, wherein the piece of produce is positioned on the target area with the produce pusher in alignment with the target area.

12. The produce slicer of claim 10, wherein the pusher head is movable relative to blade assembly to push the at least one piece of produce through blades of the blade assembly.

13. The produce slicer of claim 10, wherein the blade assembly comprises a plurality of blades and each of the blades of the blade assembly is positioned in alignment with a spacer of the plurality of spacers of the produce pusher and the blade assembly and the produce pusher are configured for the fins of the produce pusher to extend between the blades of the blade assembly.

14. The produce slicer of claim 10, wherein the projection, the plurality of fins, and the plurality of spacers all extend across the base plate for the depth dimension of the base plate and the plurality of fins and the plurality of spacers are all parallel to the projection and are alternatingly stacked outwards from the projection to an extent of the base plate in the width dimension.

15. A produce pusher for use in a produce slicer, the produce pusher comprising:

a T-bracket comprising:

a base plate generally extending in a plane in a width dimension and a depth dimension;

a projection in unitary construction with the base plate and centered relative to the base plate, the projection extending across the base plate in the depth dimension and extending away from the base plate in a height dimension; and depressions that extend across the base plate in the depth dimension at the intersection between the projection and the base plate;

a plurality of fins, each fin of the plurality in having a flat engagement surface in contact with the base plate, each fin of the plurality extending across the base plate in the depth dimension and extending away from the base plate in the height dimension, wherein a first fin and a second fin of the plurality of fins extend parallel to and in contact with the projection, wherein a third fin of the plurality of fins extends parallel to the first fin on a side of the first fin opposite the projection and a fourth fin of the plurality of fins extends parallel to the second fin on a side of the second fin opposite the projection;

a plurality of spacers, each spacer of the plurality of spacers having a flat engagement surface in contact with the base plate, each spacer of the plurality of spacers extending across the base plate in the depth dimension and extending away from the base plate in the height dimension, wherein a first spacer of the plurality of spacers is positioned between the first and third fins and a second spacer of the plurality of spacers is positioned between the second and fourth fins, wherein the plurality of spacers and the plurality of fins are all parallel to the projection and are alternatingly stacked outwards from the projection to an extent of the base plate in the width dimension; and a first fastener that extends through a first set of holes through the plurality of fins, the plurality of spacers and the projection and second fastener that extends through a second set of holes through the plurality of fins, the plurality of spacers and the projection wherein the first fastener and the second fastener simultaneously apply a first compressive force to the first fin, the third fin, and the first spacer against the projection and apply a second compressive force to the second fin, the fourth fin, and the second spacer against the projection.

* * * * *